US008419468B2

(12) United States Patent
Alrutz et al.

(10) Patent No.: US 8,419,468 B2
(45) Date of Patent: Apr. 16, 2013

(54) COAXIAL CONNECTORS HAVING BACKWARDS COMPATABILITY WITH F-STYLE FEMALE CONNECTOR PORTS AND RELATED FEMALE CONNECTOR PORTS, ADAPTERS AND METHODS

(75) Inventors: Mark Alrutz, Hickory, NC (US); Christopher Paul Gemme, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 294 days.

(21) Appl. No.: 12/816,988

(22) Filed: Jun. 16, 2010

(65) Prior Publication Data

US 2011/0312199 A1 Dec. 22, 2011

(51) Int. Cl.
*H01R 9/05* (2006.01)

(52) U.S. Cl.
USPC ..... 439/578; 439/321

(58) Field of Classification Search ..... 439/278–285
See application file for complete search history.

(56) References Cited

U.S. PATENT DOCUMENTS 3,671,926 A * 6/1972 Zdenek Nepovim ..... 439/584
4,037,909 A * 7/1977 Trompeter et al. ..... 439/584
4,156,554 A * 5/1979 Aujla ..... 439/584
5,321,207 A * 6/1994 Huang ..... 174/75 C
5,326,280 A 7/1994 Briones et al.
5,651,698 A * 7/1997 Locati et al. ..... 439/578
6,102,738 A * 8/2000 Macek et al. ..... 439/584
6,152,743 A 11/2000 Fox
6,174,206 B1 1/2001 Yentile et al.
6,817,896 B2 * 11/2004 Derenthal ..... 439/578
6,884,115 B2 * 4/2005 Malloy ..... 439/584
7,163,420 B2 * 1/2007 Montena ..... 439/578
7,566,236 B2 7/2009 Malloy et al.
7,740,502 B2 * 6/2010 Blew et al. ..... 439/578
7,811,133 B2 * 10/2010 Gray ..... 439/607.41

* cited by examiner

*Primary Examiner* — Thanh Tam Le

(74) *Attorney, Agent, or Firm* — Myers Bigel Sibley & Sajovec

(57) ABSTRACT

Coaxial connectors are provided that include a connector body having a front end and a rear end, an inner contact post that is at least partly within the connector body, a first internally-threaded nut that is positioned at the front end of the connector body and that is connected to at least one of the connector body and the inner contact post and a second structure that is attached to the first internally-threaded nut. In some embodiments, the second structure may comprise an internally-threaded nut. In other embodiments, the second structure may comprise a locking member. Corresponding female connector ports are also provided.

10 Claims, 8 Drawing Sheets

COAXIAL CONNECTORS HAVING BACKWARDS COMPATABILITY WITH F-STYLE FEMALE CONNECTOR PORTS AND RELATED FEMALE CONNECTOR PORTS, ADAPTERS AND METHODS

FIELD OF THE INVENTION

The present invention relates generally to connectors for communications cables and, more particularly, to connectors for coaxial cables.

BACKGROUND

Coaxial cables are a well-known type of electrical cable that may be used to carry information signals such as television or data signals. Coaxial cables are widely used in cable television networks and to provide broadband Internet connectivity. FIGS. 1A and 1B are, respectively, a schematic transverse cross-sectional view and a schematic longitudinal cross-sectional view of a conventional coaxial cable 10 (FIG. 1B is taken along the cross section 1B-1B shown in FIG. 1A). As shown in FIGS. 1A and 1B, the coaxial cable 10 has a central conductor 12 that is surrounded by a dielectric 14. A tape 16 is preferentially bonded to the dielectric 14. The central conductor 12, dielectric 14 and tape 16 comprise the core 18 of the cable. Electrical shielding wires 20 and, optionally, electrical shielding tape(s) 22 surround the cable core 18. Finally, a cable jacket 24 surrounds the electrical shielding wires 20 and electrical shielding tape(s) 22. As shown in FIG. 1B, the dielectric 14, tape 16, electrical shielding wires 20, electrical shielding tape 22 and cable jacket 24 may be cut, and the electrical shielding wires 20, electrical shielding tape 22 and cable jacket 24 may be folded back, in order to prepare the coaxial cable 10 for attachment to certain types of coaxial connectors.

Typically, each end of a coaxial cable is terminated with either a male coaxial connector or a female coaxial connector port. The two most common types of coaxial connectors are "F-style" coaxial connectors and "bayonet navy connectors", which are typically referred to as "BNC-style" coaxial connectors. Both F-style and BNC-style coaxial connectors include a male connector and a corresponding female connector port that is configured to mate with the male connector.

BNC-style coaxial connectors are often used in indoor applications. Typically, a male BNC-style connector includes a center pin that acts as a center contact. This center pin is typically crimped onto the center conductor of the coaxial cable on which the male BNC-style connector is mounted. The male BNC-style connector may also include a pair of arcuate grooves in the housing thereof that are configured to receive respective bayonet connector pins on a mating BNC-style female connector port. The arcuate grooves and bayonet connector pins act as a locking mechanism that allows an installer to lock the male BNC-style connector onto the female BNC-style connector port.

To attach a male BNC-style connector onto a female BNC-style connector port, an installer pushes the male connector onto the female connector port while turning the male connector ninety degrees in the clockwise direction (when facing the female connector port). As the male connector rotates, the bayonet connector pins on the female connector port travel in the respective arcuate grooves on the male connector until they are received within locking apertures that are provided at the end of each groove, at which point the male connector is locked onto the female connector port. To remove the male BNC-style connector from the female connector port, the installer pushes the male connector further onto the female connector port to disengage the bayonet connector pins from the locking apertures, and then rotates the male connector ninety degrees in the counter-clockwise direction. The above-described center pin and bayonet locking mechanism on BNC-style connectors facilitates providing a good electrical and mechanical connection between the male BNC-style connector and the female BNC-style connector port. BNC-style connectors may also be connected and disconnected very quickly, due to their pin-in-groove locking mechanism. BNC-style connectors, however, typically do not provide a hermetic seal, and hence generally are not suitable for outdoor use.

F-style coaxial connectors are used in both indoor and outdoor applications. A number of different types of F-style coaxial connector designs are known, including, but not limited to, crimped connectors, swaged connectors and connectors which secure the cable into the connector with compression-style cable retention elements. F-style coaxial connectors connect to a female connector port via an internally-threaded nut that is provided on the front end of the male connector.

SUMMARY

Pursuant to embodiments of the present invention, coaxial connectors are provided that include a connector body, an inner contact post that is at least partly within the connector body, a first internally-threaded nut that is positioned at a front end of the connector body and that is connected to at least one of the connector body and the inner contact post and a second internally-threaded nut that is attached to the first internally-threaded nut.

In some embodiments, the coaxial connector further includes a locking mechanism that is attached to or that is part of the second internally-threaded nut. In some embodiments, this locking mechanism is a cam lock mechanism that is part of a separate locking member that is rotatably attached to the second internally-threaded nut. In some embodiments, the locking mechanism may be part of a separate locking member and may include a switch activator such as, for example, a groove that has a variable depth on an interior surface of the locking member. This groove may be configured to engage and push in a pin on a female connector port when the locking member is mounted on the female connector port and rotated to lock the coaxial connector in place on the female connector port.

In some embodiments, the coaxial connector may also include a compression wedge that is mounted within the second internally-threaded nut and a stop that is mounted within the second internally-threaded nut adjacent a first end of the compression wedge. The stop may have a surface that is configured to compress an exterior surface of the first end of the compression wedge inwardly when the compression wedge is forced against the surface. In such embodiments, the connector may also include a conductive pin that is positioned to run through a first aperture in the compression wedge and a second aperture in the stop.

In some embodiments, the first internally-threaded nut may include an annular ridge on a front end thereof, and the second internally-threaded nut may include an annular groove that is configured to mate with the annular ridge. The coaxial connector may be provided in combination with a coaxial cable to provide a coaxial patch cord.

Pursuant to further embodiments of the present invention, coaxial connectors are provided which include a connector body, an inner contact post that is at least partly within the connector body, a first internally-threaded nut that is positioned at a front end of the connector body and a locking member that includes a locking mechanism that is attached to a front end of the first internally-threaded nut.

In some embodiments, the locking member may be a separate rotatably-mounted cam-lock nut. The locking member may be a rotatable locking member that is separate from the first internally-threaded nut that is directly connected to the first internally-threaded nut. The coaxial connector may further include a second internally-threaded nut, where the first internally-threaded nut is directly connected to a first end of the second internally-threaded nut and the locking member is rotatably connected to a second end of the second internally-threaded nut that is opposite the first end.

In some embodiments, the coaxial connector may further include a compression wedge that is mounted within the second internally-threaded nut and a stop that is mounted within the second internally-threaded nut adjacent a first end of the compression wedge. This stop may have a surface that is configured to compress an exterior surface of the compression wedge inwardly when the first end of the compression wedge is forced against the surface. The coaxial connector may also include a conductive pin that is positioned to run through a first aperture in the compression wedge and a second aperture in the stop.

In some embodiments, the locking member nay further include a switch activator. This switch activator may be implemented, for example, as a groove that has a variable depth on an interior surface of the locking member. The groove may be configured to engage and push in a pin on a female connector port when the locking member is inserted onto the female connector port and rotated to lock the coaxial connector in place on the female connector port.

In some embodiments, the first internally-threaded nut may include an annular ridge on a front end thereof, and the second internally-threaded nut may include an annular groove that is configured to mate with the annular ridge. Moreover, the locking member may comprise a lip extending from a front end of the first internally-threaded nut that includes a locking mechanism on an internal surface thereof. The coaxial connector may be provided in combination with a coaxial cable to provide a coaxial patch cord.

Pursuant to still further embodiments of the present invention, adapters for coaxial connectors are provided that include a member that has at least one of a locking mechanism that is configured to lock the adapter onto a female connector port or a switch activator such as, for example, a groove that has a variable depth on an interior surface of the member. The member may be configured to directly attach to a front end of an F-style coaxial connector. In some embodiments, the member may directly attach to the internally-threaded nut of the F-style coaxial connector.

In some embodiments, the adapter may include an internally threaded nut, and the member may be attached to the internally threaded nut. In such embodiments, the adapter may further include a compression wedge that is mounted within the internally-threaded nut and a stop that is mounted within the internally-threaded nut adjacent a first end of the compression wedge, the stop having a surface that is configured to compress an exterior surface of the compression wedge inwardly when the first end of the compression wedge is forced against the surface. The adapter may also include a conductive pin that is positioned to run through a first aperture in the compression wedge and a second aperture in the stop.

Pursuant to yet additional embodiments of the present invention, female coaxial connector ports are provided that comprise an externally threaded bolt having an aperture at a distal end thereof and a first pin mounted in a side surface of the externally-threaded bolt.

In some embodiments, the first pin may be a spring-loaded member that activates a conductive path through the female connector port when the first pin is forced from a first resting position to a second tensioned position. A second spring-loaded pin may be mounted in the side surface of the externally-threaded bolt generally opposite the first pin. In other embodiments, the female connector port may include a second pin mounted in the side surface of the externally-threaded bolt generally opposite the first pin, and the first and second pins may be configured to mate with grooves in a mating cam-lock nut of a male coaxial connector. In still other embodiments, the female connector port may further include a second pin and a third pin that are mounted in the side surface of the externally-threaded bolt, where the second and third pins are configured to mate with grooves in a mating cam-lock nut of a male coaxial connector.

Pursuant to still further embodiments of the present invention, coaxial connectors are provided that include a connector body having a first end that is configured to receive an end of a coaxial cable and a second end opposite the first end. A first nut is attached to the second end of the connector body. The first nut includes a first switch activator that is configured to engage an element of a first switch that is provided on a female coaxial connector port when the first nut is attached to the female coaxial connector port so as to close the switch to thereby allow communications signals to pass between the coaxial connector and the female coaxial connector port.

In some embodiments, the coaxial connector further includes a second switch activator that is configured to engage an element of a switch that is provided on the female coaxial connector port. The first nut may be an internally-threaded nut that is rotatably connected to the connector body via direct attachment to an inner contact post that is at least partly within the connector body. The coaxial connector may further include an inner contact post that is at least partly within the connector body and a second internally-threaded nut that has a first end that is rotatably connected to the connector body via direct attachment to the inner contact post. In such embodiments, a second end of the second internally-threaded nut may be connected to the first nut so that the first nut is attached to the connector body via the second internally-threaded nut.

In some embodiments, the first nut may be an internally-threaded nut and may include a locking mechanism such as, for example, a cam-lock mechanism. The first switch activator may be a groove that has a variable depth on an interior surface of the first nut, where the groove is configured to engage and push in a pin on a female connector port when the first nut is inserted onto the female connector port and rotated relative to the female connector port.

Pursuant to additional embodiments of the present invention, methods of establishing a radio frequency communications path between a male coaxial connector and a female coaxial connector port are provided. Pursuant to these methods, a center conductor of the male coaxial connector is inserted into a center conductor receiving aperture of the female coaxial connector port to make electrical contact with a center conductor of the female connector port. A nut on the male coaxial connector is rotated to firmly mount the male coaxial connector onto the female coaxial connector port. An activation circuit within the female connector port is then closed in order to complete a communications path through the female connector port.

In some embodiments, the rotation of the nut closes the activation circuit within the female connector port in order to complete the communications path through the female connector port. Moreover, the nut on the male connector may include an activation member actuator and the female connector port may include an activation member that completes the communications path through the female connector port when engaged by the activation member actuator. The activation member actuator may be a groove that has a variable depth on an interior surface of the nut on the male coaxial connector port. The activation member may be a pin that extends from a side surface of the female connector port that travels within the groove when the nut is rotated to firmly mount the male coaxial connector onto the female coaxial connector port.

DETAILED DESCRIPTION

Figure 1A:
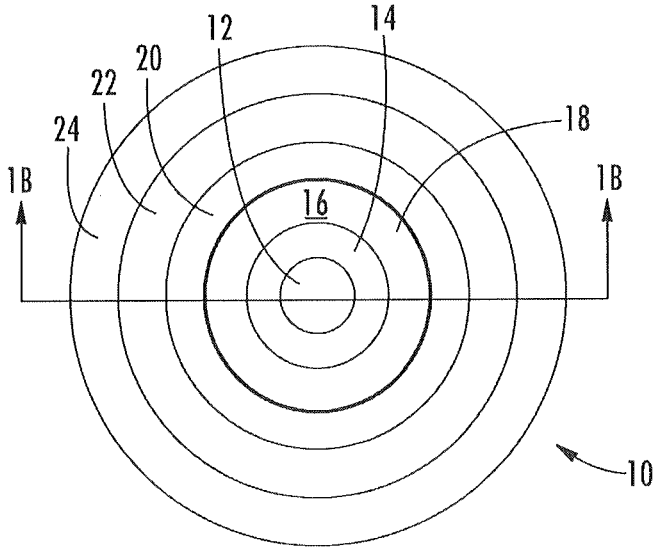
FIGS. 1A and 1B are, respectively, a schematic transverse cross-sectional view and a schematic longitudinal cross-sectional view of a conventional coaxial cable.

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the size of lines and elements may be exaggerated for clarity. It will also be understood that when an element is referred to as being "coupled" to another element, it can be coupled directly to the other element, or intervening elements may also be present. In contrast, when an element is referred to as being "directly coupled" to another element, there are no intervening elements present. Likewise, it will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present.

This invention is directed to coaxial connectors. As used herein, the term "longitudinal" and derivatives thereof refer to the direction defined by the central axis of the coaxial connector, which is generally coexistent with the central axis of any coaxial cable that the coaxial connector is installed on when the coaxial cable is fully extended in a straight line. The term "transverse" and derivatives thereof refer to the plane that is normal to the longitudinal direction. Herein, the terms "front", "front end" and derivatives thereof when used with respect to a male coaxial connector refer to the end of the male coaxial connector that mates with a female coaxial connector port such as, for example, a coaxial port on a television set, cable modem or the like. Thus, the "front" or "front end" of a male coaxial connector refers to the end of the connector that includes a protruding center conductor that is inserted into a mating female coaxial connector port. Likewise, references herein to the "rear" or "rear end" of a male coaxial connector refer to the end of the coaxial connector that is opposite the front end.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

Pursuant to some embodiments of the present invention, male coaxial connectors (and coaxial patch cords that include such male coaxial connectors) are provided that include a locking mechanism that resists against self-loosening due to vibrations, thermal cycling or rotational forces that are applied to the connector. Herein the term "locking mechanism" refers to a structure on a male coaxial connector that mates with a corresponding structure on a female coaxial connector port in order to lock the male connector onto the female connector port. The locking mechanism does not permanently lock the male connector onto the female connector port, but does provide a more secure connection than a typical threaded connection and hence will generally resist self-loosening due to vibrations, thermal cycling or rotational forces that may be applied to the connector during normal use. These male coaxial connectors according to embodiments of the present invention may have two mechanisms for attaching to a female connector port, namely the locking mechanism and a threaded connection. The threaded connection may provide a hermetic seal, while the locking mechanism may provide a second attachment that is more resistant to accidental/unintentional loosening.

The male coaxial connectors that include these locking mechanisms may be fully backwards-compatible with conventional F-style female connector ports.

Pursuant to further embodiments of the present invention, corresponding female connector ports are also provided that are fully backwards-compatible with conventional male F-style coaxial connectors. As noted above, the male coaxial connectors and the female connector ports according to embodiments of the present invention may provide a hermetic seal, and hence may be suitable for outdoor use. In some embodiments, the male connectors may include a conductive center pin that is mounted on the center conductor of the coaxial cable on which the connector is mounted. This center pin may be more robust and may provide a better mechanical and/or electrical connection as compared to conventional F-style male coaxial connectors that use the center conductor of the coaxial cable as the male protrusion of the connector.

Pursuant to still further embodiments of the present invention, male coaxial connectors (and coaxial patch cords that include such male coaxial connectors) and corresponding female connector ports are provided that only complete an electrical connection through the connector if the male connector is properly installed on the female connector port. Accordingly, an installer can readily identify an improper installation at the time the male connector is mounted on the female connector port by the fact that no signal is transmitted through an improper connection. In some embodiments, one of the male connector or the female connector port includes a switch, and the other of the male connector and the female connector port includes a switch activator that activates (i.e., closes) the switch to complete the electrical connection when the male connector is properly installed on the female connector port. For example, in some embodiments, the switch may comprise one or more pins on the female connector port that are driven inwardly into the connector port when the male connector and the female connector port are properly mated. When these pins are driven into the female connector port, they act to directly or indirectly complete an electrical circuit through the female connector port, thereby allowing communications signals to pass through the female connector port. In such embodiments, the switch activator on the mating male coaxial connector may comprise, for example, a ramped groove in a portion of the male coaxial connector that is mated over the female connector port. The switch may be any structure that selectively activates (depending upon whether the switch is "open" or "closed") a communications path through a mated male coaxial connector and female coaxial connector port. Likewise, the term "switch activator" refers to any structure that may be used to close a switch in a female coaxial connector port or in a male coaxial connector.

Various additional embodiments of male coaxial connectors and female connector ports are described below, as are related methods according to embodiments of the present invention.

Figure 2:
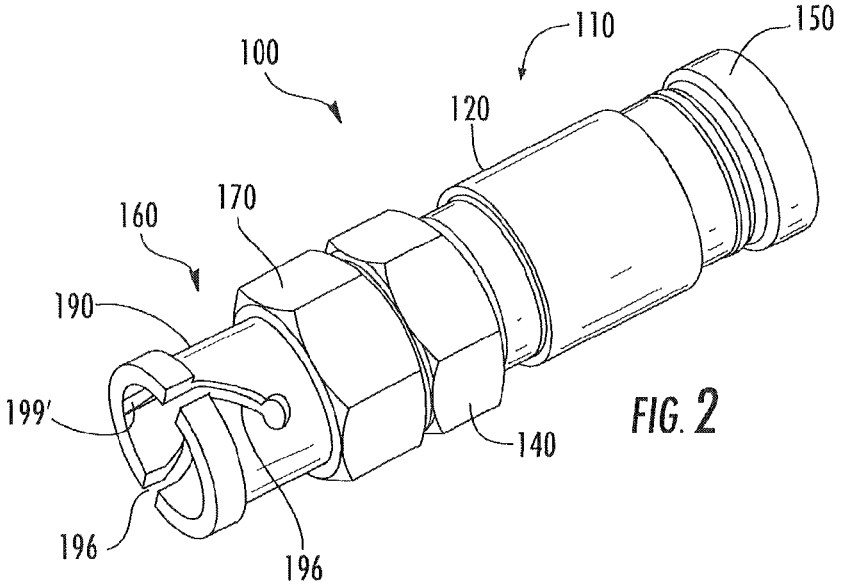
FIG. 2 is a perspective view of a male coaxial connector according to certain embodiments of the present invention.
Figure 3:
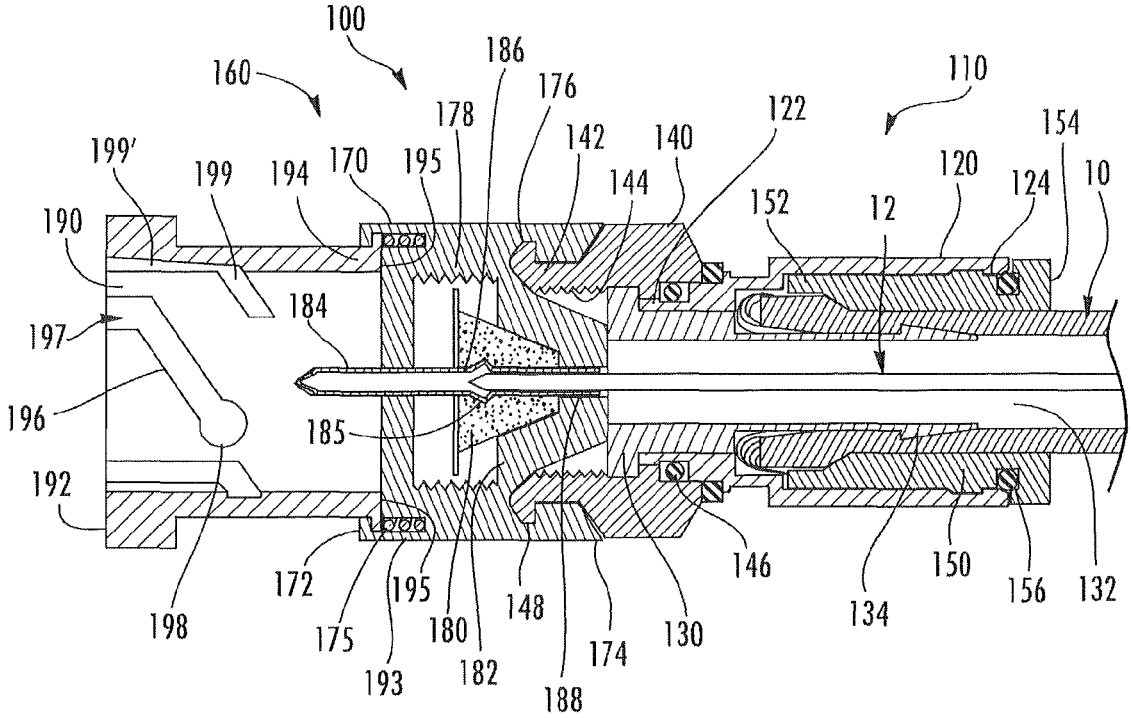
FIG. 3 is a longitudinal section view of the coaxial connector of FIG. 2.

FIG. 2 is a perspective view of a male coaxial connector 100 according to certain embodiments of the present invention. FIG. 3 is a longitudinal section view of the connector 100 of FIG. 2.

As shown in FIGS. 2-3, the connector 100 may comprise an F-style coaxial connector 110 and an adapter 160. Herein the term "adapter" refers to a device that includes a locking mechanism and/or a switch or a switch activator that may be mounted or attached to an F-style coaxial connector. The F-style coaxial connector 110 may comprise, for example, any of a wide variety of conventional F-style coaxial connectors. In some embodiments, the F-style coaxial connector 110 may include a tubular connector body 120 that has a front end 122 and a rear end 124, an inner contact post 130, an internally-threaded nut 140 and a compression sleeve 150. The connector body 120 may comprise a generally cylindrical body piece having an open interior. As shown in FIG. 3, the inner and/or outer diameters of the cylindrical body piece of the connector body 120 may vary along the length of the connector body 120. The connector body 120 may be formed, for example, of brass or steel or another metal or metal alloy.

The internally-threaded nut 140 may comprise, for example, a brass or steel nut having an exterior surface that has a hexagonal transverse cross-section. The internally-threaded nut 140 may include a lip 142 that has an exterior surface that, in some embodiments, has a non-hexagonal transverse cross-section such as, for example, a circular transverse cross-section. The lip 142 may include an annular ridge 148 at or adjacent its front end. The internally-threaded nut 140 is mounted adjacent the front end 122 of the connector body 120, and may be mounted so that the internally-threaded nut 140 may freely rotate with respect to the connector body 120. At least part of the interior surface of the internally-threaded nut 140 includes a plurality of threads 144. An O-ring, gasket or other member 146 (see FIG. 3) may be positioned between the internally threaded nut 140 and the connector body 120 to reduce or prevent water or moisture ingress into the interior of the F-style connector 110.

As shown in FIG. 3, the inner contact post 130 is mounted within both the connector body 120 and the internally-threaded nut 140. The inner contact post 130 has an open rear end 132. As shown in FIG. 3, the inner contact post 130 may be used to connect the internally-threaded nut 140 to the connector body 120, and may facilitate mounting the internally-threaded nut 140 to the connector body 120 so that the internally-threaded nut 140 may be freely rotated independent of the connector body 120. The outside surface of the inner contact post 130 may include one or more serrations, teeth, lips or other structures 134. The inner contact post 130 may comprise, for example, a brass or steel post.

The compression sleeve 150 may comprise a hollow cylindrical body having a front end 152 and a rear end 154. The compression sleeve 150 is typically formed of a plastic material, but may also be formed of other materials such as brass, rubber or the like. In some embodiments, the front end 152 of the compression sleeve 150 may have a first external diameter that is less than a second external diameter of the rear end 154 of the compression sleeve 150. A gasket or O-ring 156 (see FIG. 3) may be mounted on the exterior surface of the compression sleeve 150. In some embodiments, the gasket 156 may be mounted at the point where the diameter of the exterior surface of the compression sleeve 150 transitions from the first external diameter to the second external diameter. As shown in FIG. 3, the inner diameter of the front end 152 of the compression sleeve 150 may be greater than the inner diameter of the rear end 154 of the compression sleeve 150. A ramped transition section may connect the inner radii of the front end 152 and second end 154 of the compression sleeve 150.

The adapter 160 may be mounted, for example, on the internally-threaded nut 140 of the F-style coaxial connector 110. The adapter 160 includes a body portion 170 and a locking member 190. The body portion 170 has a front end 172 and a rear end 174. The front end 172 of body portion 170 includes an internal lip 175. An annular groove 176 is provided proximate the rear end 174. In some embodiments, the adapter 160 may be mounted on the F-style coaxial connector 110 by mounting the rear end 174 of the body portion 170 of the adapter 160 onto the lip 142 of the internally-threaded nut 140 such that the annular ridge 148 on the internally-threaded nut 140 is received within the annular groove 176 of the body portion 170. While not shown in FIG. 3, a gasket, O-ring or other structure may be mounted within, for example, the body portion 170 to prevent water or moisture ingress into the interior of the coaxial connector 110 or into the adapter 160.

While the annular ridge 148 and annular groove 176 arrangement shown in FIGS. 2 and 3 is one way that the adapter 160 may be mounted to the F-style coaxial connector 110, it will be appreciated that numerous other attachment mechanisms may be used. For example, in further embodiments of the present invention, an annular ridge may be provided on an exterior surface of the body portion 170 and an annular groove may be provided on the interior surface of the internally-threaded nut 140. In still further embodiments, a threaded attachment may be provided. In such embodiments, the threaded connection may include a locking mechanism. In still further embodiments, the body portion may be crimped onto the internally-threaded nut 140. Thus, it will be appreciated that embodiments of the present invention are not limited to the attachment mechanism depicted in FIGS. 2 and 3, but instead, any suitable attachment mechanism may be used.

As is further shown in FIG. 3, the body portion 170 has at least a partially open interior. The interior surface of the body portion includes threads 178 adjacent the front end 172 that are configured to mate with the internal threads of a standard F-style female coaxial connector port. A compression wedge 180 and a swaging block 182 are mounted in the interior of the body portion 170. A conductive pin 184 is also mounted in the interior of the body portion 170. The conductive pin 184 runs through a first aperture 186 in the compression wedge 180 and through a second aperture 188 in the swaging block 182. The conductive pin 184 may also extend forwardly from the front end 172 of the body portion 170 into the locking member 190. The conductive pin 184 may be at least partially hollow so that the center conductor of a coaxial cable may be received within the conductive pin 184, as is discussed in more detail below.

Figure 1B:
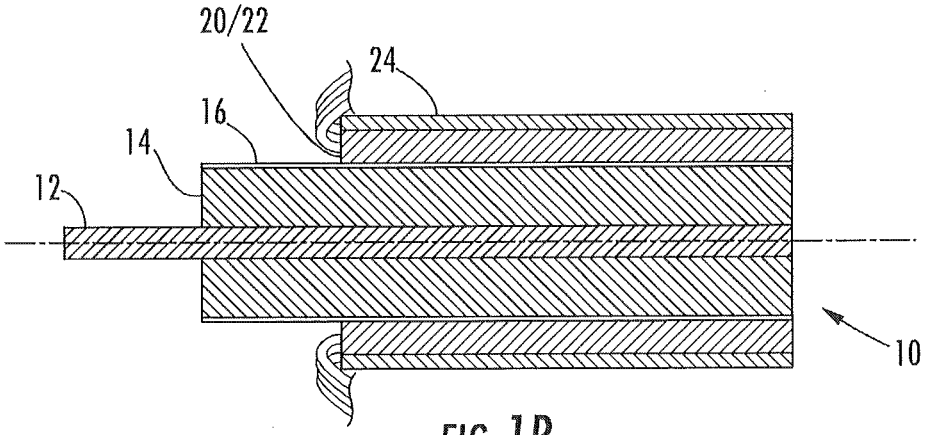

As shown in FIG. 3, the F-style coaxial connector 110 may be mounted on the end of a coaxial cable such as the coaxial cable 10 described above with reference to FIGS. 1A and 1B. When the connector 110 is mounted on the coaxial cable 10, the center conductor 12 of the coaxial cable 10 may be cut so that it extends forwardly all the way through the internally-threaded nut 140 toward and possibly into the adapter 160. In the depicted embodiment, the conductive pin 184 is completely hollow, and the center conductor 12 of coaxial cable 10 is received within an open end of the hollow conductive pin 184. An installer may then use a compression tool (not shown) to force the compression wedge 180 rearwardly toward the F-style coaxial connector 110, such that the compression wedge 180 is forced against the swaging block 182. As this occurs, the swaging block 182 exerts a generally radial force on the compression wedge 180, thereby reducing the size (e.g., the cross-sectional diameter) of the first aperture 186. As the size of the first aperture 186 is reduced, the internal surface of the compression wedge 180 that defines the first aperture 186 contacts the hollow conductive pin 184 and deforms and/or crushes the hollow conductive pin 184 onto the center conductor 12 of coaxial cable 10. Thus, the compression wedge 180 and the swaging block 182 provide a mechanism for mounting the hollow conductive pin 184 onto the center conductor 12 of the coaxial cable 10. The hollow conductive pin 184 (with the center conductor 12 therein) may provide a more robust male protrusion for the coaxial connector 100 that may make a better mechanical and/or electrical connection with a mating female connector port as compared to a center conductor of a coaxial cable as is used as the male protrusion with in conventional F-style male coaxial connectors.

The body portion 170 may comprise, for example, a metal body portion. In some embodiments, the body portion 170 may comprise multiple different materials. By way of example, the exterior surface of the body portion 170 and the swaging block 182 may comprise a metal such as steel or brass, the hollow conductive pin 184 may comprise a highly conductive metal such as beryllium-copper or phosphor-bonze, and the compression wedge 180 may comprise a hard plastic material.

The locking member 190 has a front end 192 and a rear end 194. The locking member 190 may be attached so that it freely rotates with respect to the body portion 170. A spring 193 is provided between the locking member 190 and the body portion 170. The locking member 190 further includes a pair of cam locks 196 and at least one switch activator 199. Each cam-lock 196 functions as a locking mechanism for locking the male connector 100 to a female connector port. A longitudinal groove 199' provides access to the switch activator 199. The embodiment of FIGS. 2-3 has two switch activators 199, each of which has an associated longitudinal groove 199'. The two switch activators 199 are positioned approximately 180 degrees apart from each other. As will be discussed further herein, each cam lock 196 comprises an arcuate slot 197 provided in the body of the locking member 190 that is designed to mate with a bayonet connector pin that is provided on a female coaxial connector port. A locking aperture 198 may be provided at the end of each slot 197 that captures the bayonet connector pin of the female connector port. The spring 193 allows the locking member 190 to compress into the body portion 170 when the body portion is 170 is screwed onto a female connector port, as will be discussed herein. In some embodiments, the spring 193 may be omitted.

The hollow conductive pin 184 may include external and/or internal protrusions 185. These protrusions 185 may be used to keep the conductive pin 184 from sliding out of position within the adapter 160 or from sliding completely out of the connector 100 before the connector is mounted on a coaxial cable 10 and the hollow conductive pin crushed onto the center conductor 12 of the coaxial cable 10. In the embodiment of FIG. 3, the conductive pin includes external protrusions 185 that fit within an enlarged section of the first aperture 186 through the compression wedge 180, thereby holding the conductive pin 184 in a fixed position with respect to the compression wedge 180. It will be appreciated that the external protrusions 185 may be located in other places such as, for example, to fit within an enlarged section of the second aperture 188 through the swaging block 182. It will also be appreciated that the external protrusions 185 could be replaced in other embodiments with, for example, internal protrusions (not shown in FIG. 3) that mate with, for example, a section of the first or second apertures 186, 188 that has a reduced diameter (not shown in FIG. 3) to hold the conductive pin 184 in a fixed position with respect to the compression wedge 180 or the swaging block 182.

Figure 4:
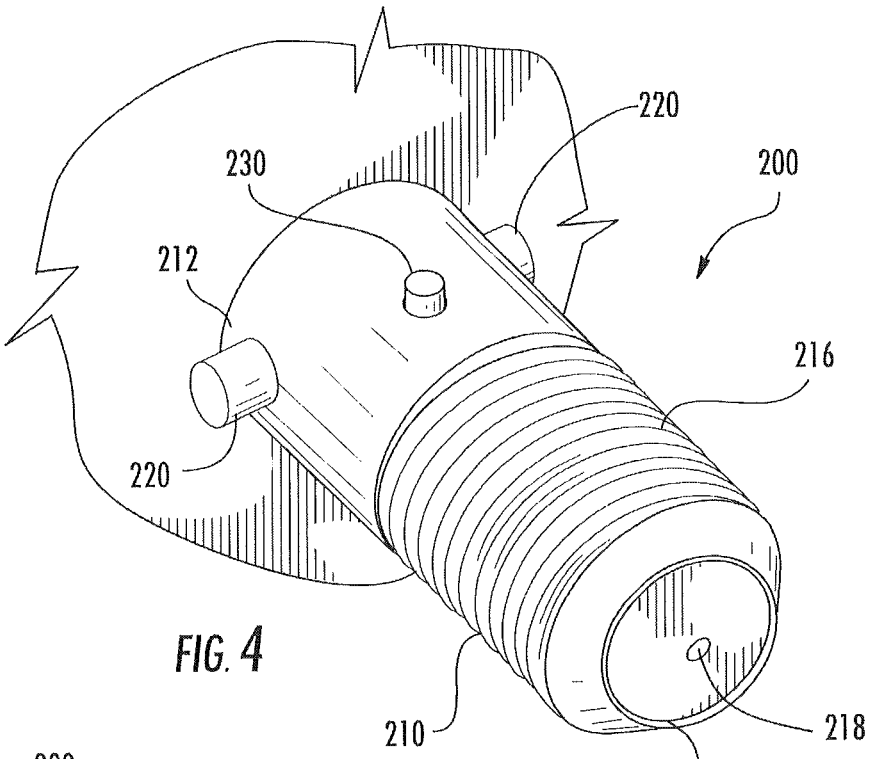
FIG. 4 is a perspective view of a female coaxial connector port according to certain embodiments of the present invention.
Figure 5:
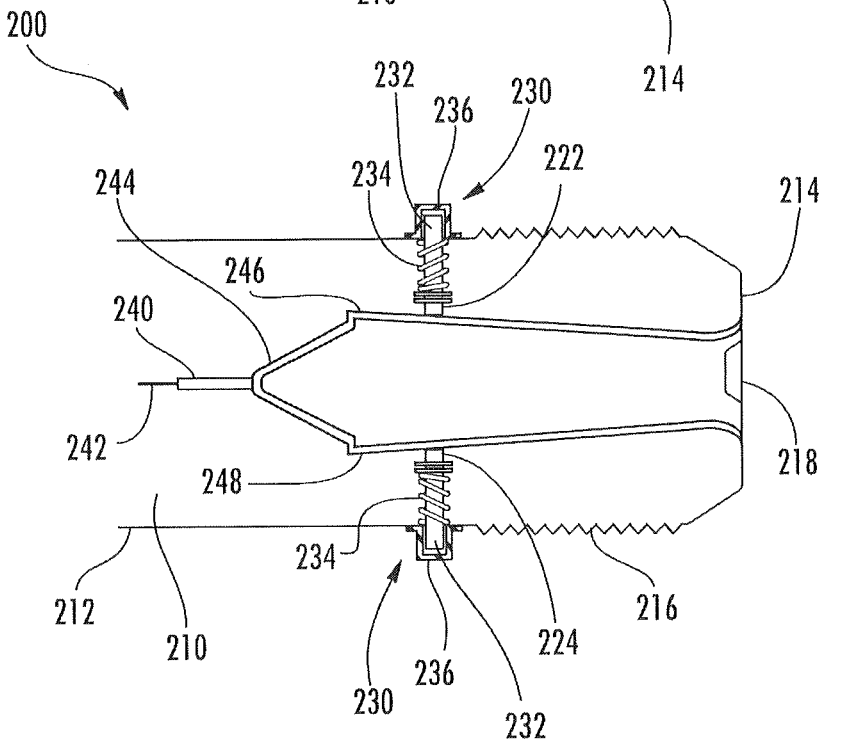
FIG. 5 is a longitudinal section view of the female coaxial connector port of FIG. 4.

FIG. 4 is a perspective view of a female coaxial connector port 200 according to certain embodiments of the present invention. FIG. 5 is a longitudinal section view of the female connector port 200 of FIG. 4.

Turning first to FIG. 4, it can be seen that the female connector port 200 includes a cylindrical body 210 that has a base 212 and a distal end 214. At least part of the external surface of the body 210 includes external threads 216. The distal end 214 of the body 210 may have a generally circular transverse cross-section. An aperture 218 for receiving the center conductor of a mating male coaxial connector is provided in the center of the distal end 214 of the body 210. The above-described elements of female connector port 200 are conventional components of a female F-style coaxial connector port.

As is further shown in FIG. 4, the female connector port 200 further includes a pair of bayonet connector pins 220 that are mounted to extend from, for example, side surfaces of the cylindrical body 210. In some embodiments, the bayonet connector pins 220 may be mounted generally opposite each other (i.e., about 180 degrees around the cylindrical body 210 from each other). These bayonet connector pins 220 are designed to travel within the arcuate slots 197 of the cam lock 196 of male coaxial connector 100 when the connector 100 is mounted on the female connector port 200 and rotated 90 degrees. The female connector port 200 further includes a pair of spring-loaded activation pins 230. As will be discussed in detail herein, the activation pins 230 are part of a switch that is used to complete a communications path through the female connector port 200.

Turning next to FIG. 5, it can be seen that the activation pins 230 are each mounted in a respective one of two apertures 222, 224 in the top and bottom surfaces, respectively, of the cylindrical body 210. Each activation pin 230 comprises a detent pin 232, a spring 234 and a non-metallic sealing cap 236. An O-ring or gasket (not shown) may also be provided to protect against water or moisture ingress into the interior of the female connector port 200. A central conductor 240 runs longitudinally through the middle of the female connector port 200. A first end 242 of the central conductor 240 runs toward the base 212 of the cylindrical body 210. A central section 244 of the central conductor 240 includes a fork that divides the central conductor 240 into two prongs 246, 248 that run toward the distal end 214 of the cylindrical body 210. Each of the activation pins 230 is configured to engage a respective one of the prongs 246, 248 when the activation pins 230 are forced inwardly into the cylindrical body 210.

Operation of the male coaxial connector 100 and the female coaxial connector port 200 will now be described with reference to FIGS. 2-5.

An installer first places the locking member 190 of connector 100 onto the distal end 214 of the cylindrical body 210 of the female connector port 200 so that the conductive pin 184 of male connector 100 is aligned with the aperture 218 of the female connector port 200. The installer pushes the connector 100 onto the female connector port 200 (and hence the conductive pin 184 into the aperture 218) until the internal threads 178 of the body portion 170 of connector 100 engage the external threads 216 on the female connector port 200. The installer then rotates the body portion 170 (which may rotate independently of the internally-threaded nut 140) in order to thread the body portion 170 of connector 100 onto the female connector port 200. The threaded connection between the internal threads 178 of the body portion 170 and the external threads 216 on the female connector port 200 may provide a hermetic seal that prevents moisture from seeping into the interior of the connector 100 or into the interior of the female connector port 200. As the body portion 170 is threaded onto the female connector port 200, the locking member 190 may compress into the body portion 170.

Once the body portion 170 is fully threaded onto the female connector port 200, the installer may grasp the locking portion 190 of connector 100 and align the open ends of the arcuate slots 197 with the bayonet connector pins 220 on the female connector port 200. The installer then rotates the locking member 190 ninety degrees in the clockwise direction. As the locking member 190 is rotated, the bayonet connector pins 220 travel within the arcuate slots 197. Once the locking member 190 has been rotated through a quarter turn, each bayonet connector pin 220 is received within its respective locking aperture 198, thereby locking the male connector 100 onto the female connector port 200. Note that, in some embodiments, the locking member 190 may only be mated with the bayonet connector pins 220 on the female connector port 200 if the connector 100 has been fully threaded onto the female connector port 200.

As discussed above, the interior surface of the locking member 190 includes a pair of longitudinal grooves 199', each of which provides access to a respective one of the switch activators 199. When the locking member 190 is mounted on the female connector port 200, each activation pin 230 is aligned with a respective one of the longitudinal grooves 199'. As the locking member 190 is placed onto over the female connector port 200, the activation pins 230 travel through their respective longitudinal grooves 199'. As discussed above, each longitudinal groove 199' ends in a respective one of the switch activators 199. Each switch activator 199 may comprise an arcuate groove 199 on the internal surface of the locking member 190 that has a decreasing depth as the arcuate groove 199 extends from the front end 192 toward the rear end 194 of the locking member 190. Thus, when the installer rotates the locking member 190 to lock the bayonet connector pins 220 of the female connector port 200 into their respective locking apertures 198 on the locking member 190, the activation pins 230 travel through their respective internal arcuate grooves 199.

Since the depth of each arcuate groove decreases with increasing distance from the front end 192 of the locking member 190, as the locking member 190 is rotated further onto the female connector port 200, the body of the locking member 190 at the bottom of the internal arcuate grooves 199 gradually forces the activation pins 230 inwardly into the interior of the female connector port 200 due to the decreasing depth of each groove 199. As the activation pins 230 move inwardly, they engage respective ones of the prongs 246, 248 of the center conductor 240, and thereby force the prongs 246, 248 together. The end of each of the prongs 246, 248 may have the shape of half of the mouth of a trumpet. Thus, when the prongs 246, 248 are forced together by the activation pins 230, the end of the prongs 246, 248 may have the shape similar to the shape of the mouth of a trumpet proximate the aperture 218. The diameter of the opening into this trumpet shaped structure formed by the prongs 246, 248 (once the prongs 246, 248 have been forced together) may be less than the diameter of the conductive pin 184 of the male coaxial connector 100 of FIGS. 2-3. Consequently, when the hollow conductive pin 184 of the connector 100 is inserted into the aperture 218 of connector port 200, it will establish a good mechanical and electrical connection with the prongs 246, 248 of center conductor 240 so long as the activation pins 230 have pushed the prongs 246, 248 together. The connector port 200 may be designed so that when the activation pins 230 are in their resting positions extending outside of the connector body 210, the prongs 246, 248 will sit in resting positions within the cylindrical body 210 such that they will not contact any conductive pin (e.g., pin 184) that is received within the aperture 218.

Thus, as should be clear from the above description, the activation pins 230 may be used to control whether or not an electrical connection is made between the conductive pin 184 of the male connector 100 (when it is received within the aperture 218) and the center conductor 240 of the connector port 200. As such, if the male connector 100 is not properly mounted on the female connector port 200 such that the activation pins 230 are forced into their engaged positions within the cylindrical body 210, electrical signals cannot pass through the female connector port 200 to the male connector 100 since the prongs 246, 248 do not mechanically or electrically connect to the conductive pin 184. As such, if an installer improperly installs the male connector 100 on the female connector port 200, it should be readily apparent to the installer during any testing of the connection that the male connector 100 was improperly installed, as no signal will pass from the male connector 100 to the female connector port 200 (or vice versa). This can help installers identify improper connections at the time the connection is made, thereby reducing the need for follow-up visits by installers to examine and correct faulty installations.

Figure 6:
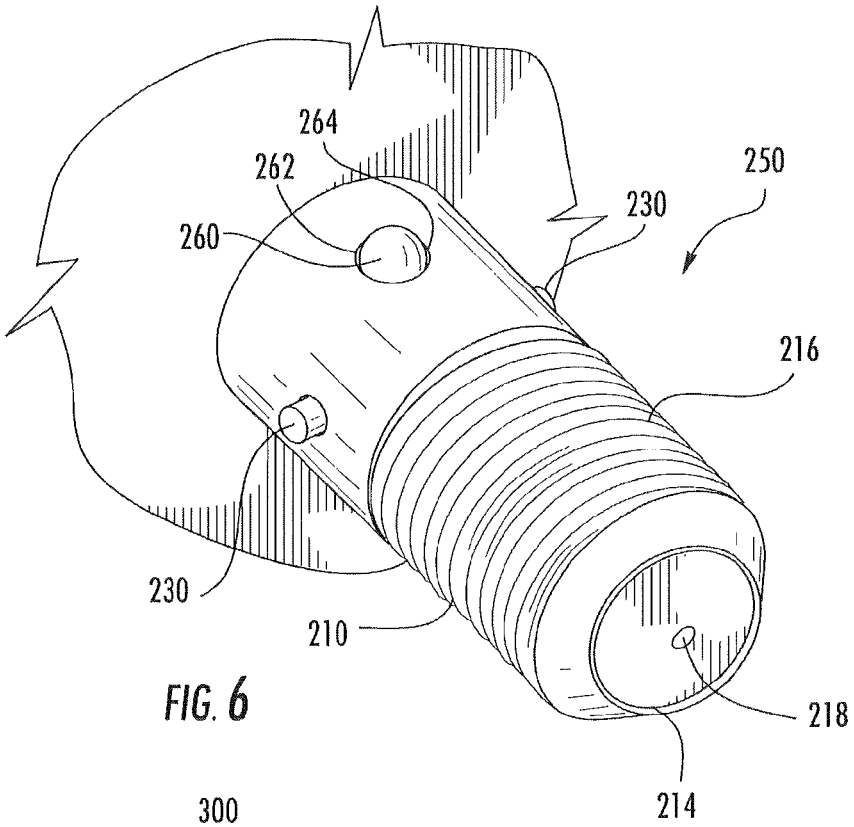
FIG. 6 is a perspective view of a female coaxial connector port according to further embodiments of the present invention.
Figure 7:
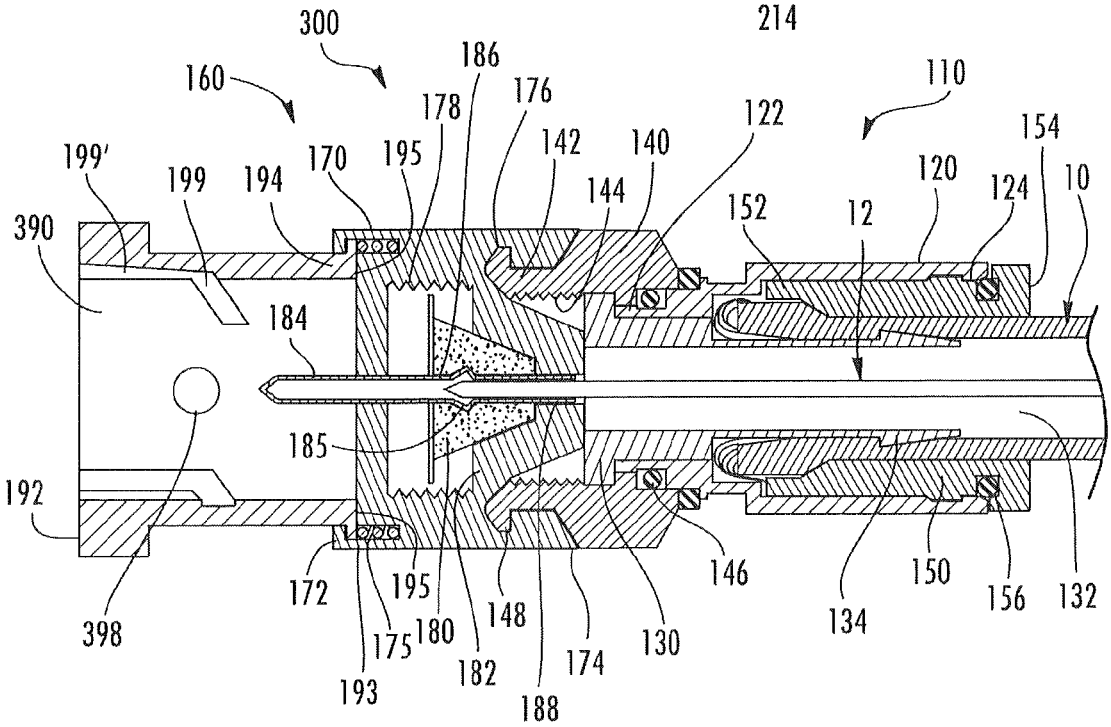
FIG. 7 is a longitudinal section view of a male coaxial connector according to further embodiments of the present invention that may be used with the female coaxial connector port of FIG. 6.

While FIGS. 4 and 5 illustrate a female connector port 200 according to certain embodiments of the present invention, it will be appreciated that many modifications may be made to the illustrated embodiments. By way of example, a wide variety of different locking mechanisms could be used in place of the bayonet pins 220 provided on the female connector port 200 and the corresponding cam locks 196 on the male coaxial connector 100. For instance, FIGS. 6 and 7 illustrate a female coaxial connector port 250 and a male coaxial connector port 300 according to further embodiments of the present invention that use a spring-loaded ball-bearing locking system to lock the male coaxial connector 300 onto the female connector port 250. In particular, FIG. 6 is a perspective view of the female coaxial connector port 250, and FIG. 7 is a longitudinal section view of the male coaxial connector 300.

As shown in FIG. 6, the female connector port 250 may be identical to the female connector port 200 that is described above with respect to FIGS. 4 and 5, except that in the connector port 250, the bayonet connector pins 220 of connector port 200 are replaced with a pair of spring loaded ball bearings 260 (note that the female connector port 250 of FIG. 6 has been rotated 90 degrees as compared to the female connector port 200 of FIG. 4). Accordingly, like elements of female connector ports 200 and 250 are labeled with like reference numerals, and such elements will not be discussed further herein.

As shown in FIG. 6, the cylindrical body 210 includes an aperture 262 in the top surface thereof that provides an opening into a cavity 264. A ball bearing 260 is positioned within the cavity 264, and a spring (not visible in FIG. 6) is provided between the bottom of cavity 264 and the ball bearing 260 in order to bias the ball bearing 260 to extend through the aperture 262 of cavity 264. A similar aperture 262, cavity 264 and spring loaded ball bearing 260 (which are not visible in FIG. 6) are provided on the bottom surface of body 210. Each aperture 262 may have a diameter $D_1$, and each ball bearing 260 may have a diameter $D_2$, where $D_2$ is greater than $D_1$. Consequently, the apertures 262 act to maintain the ball bearings 260 within their respective cavities 264. While the springs bias each ball bearing 260 to extend through its respective associated aperture 262, they are configured such that if a sufficient force is applied, the springs will compress and each ball bearing 260 will move fully within its respective cavity 264. When this force is removed, the springs will again bias each ball bearing 260 to move into its resting position where a portion of the ball bearing 260 extends through its respective aperture 262 so that the ball bearing 260 partially resides outside its aperture 264.

Turning next to FIG. 7, it can be seen that the male coaxial connector 300 may be identical to the male coaxial connector 100 that is described above with respect to FIGS. 2 and 3, except that the male coaxial connector 300 includes a locking member 390 in lieu if the locking member 190 provided on the connector 100. Accordingly, like elements of connector 300 are labeled with the same reference numerals as their corresponding elements of connector 100, and those elements will not be described further herein.

As shown in FIG. 7, the locking member 390 may be similar to the locking member 190 of coaxial connector 100, except that the pair of cam locks 196 are omitted and, in their place, a pair of circular apertures 398 are provided in the locking member 390 (only one of the circular apertures 398 is visible in FIG. 7). Each circular aperture 398 may be sized so as to readily receive the portion of one of the ball bearings 260 that extends through aperture 262 of female connector port 250 when the connector 300 is mounted on the female connector port 250. As the locking member 390 is advanced and rotated onto the female connector port 250, eventually the distal end 192 of locking member 390 engages the ball bearings 260, and each ball bearing 260 is forced into its respective cavity 264 as the locking member 390 is pushed over the ball bearings 260 and farther onto the female connector port 250. Once the male coaxial connector 300 is mounted as far it will go onto the connector port 250, the apertures 398 are transversely aligned with the ball bearings 260. The locking member 390 may thus be rotated by the installer (if necessary) so that the ball bearings 260 are also longitudinally aligned with the apertures 398, at which point the springs that are mounted in the cavities 264 force each respective ball bearing 260 to push through its respective aperture 262 and into a respective one of the apertures 398 on the locking member 390. The ball bearings 260 may be designed to extend sufficiently into the apertures 398 such that the connector 300 is locked onto the female connector port 250. To remove the connector 300 from the connector port 250, an installer may manually push each of the ball bearings 260 into the cavities 264 so that the ball bearings 260 are no longer within the apertures 398. The installer may then rotate and pull the locking member 390 towards the distal end 214 of the female connector port 250 until the apertures 398 are no longer aligned with the ball bearings 260. Then, the installer may unthread the body portion 170 of connector 300 from the female connector port 250 to fully remove the male coaxial connector 300 from the female connector port 250.

Figure 8:
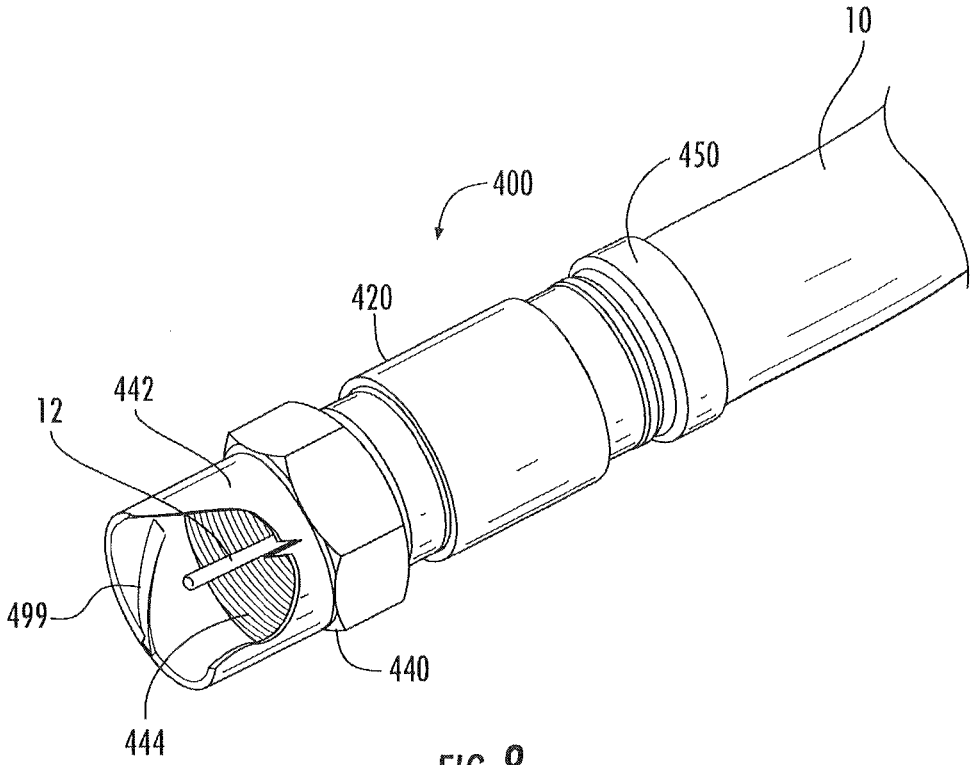
FIG. 8 is a partially cut-away perspective view of a male coaxial connector according to further embodiments of the present invention.
Figure 9:
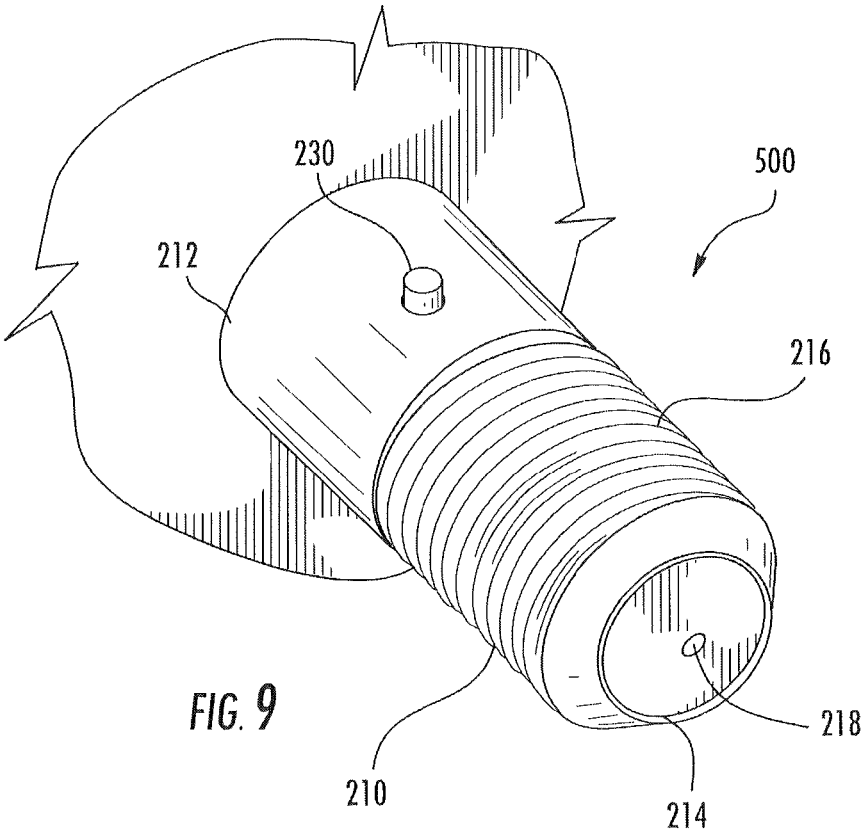
FIG. 9 is a perspective view of a female coaxial connector port according to certain embodiments of the present invention that may be used with the male coaxial connector of FIG. 8.

It will also be appreciated that coaxial connectors may be provided according to further embodiments of the present invention that only include some of the functionality of the above-described male coaxial connectors and female connector ports. By way of example, FIG. 8 is a partially cut-away perspective view of a male coaxial connector 400 according to further embodiments of the present invention that includes a switch activator, but that does not include a locking member. FIG. 9 is a perspective view of a female connector port 500 that could be used with the male coaxial connector 400 of FIG. 8.

The male coaxial connector 400 depicted in FIG. 8 includes a generally cylindrical connector body 420 that has an open interior, an inner contact post (not visible in FIG. 8) that is mounted within the connector body 420, an internally-threaded nut 440 and a compression sleeve 450. The inner contact post may be identical to the inner contact post 130 of connector 100, and may be used to rotationally attach the internally-threaded nut 440 to the connector body 420. The connector body 420, the inner contact post and the internally-threaded nut 440 may each be formed, for example, of steel or brass. The compression sleeve 450 may be identical to the above-described compression sleeve 150 of connector 100.

The internally-threaded nut 440 may have an exterior surface that has a hexagonal transverse cross-section. The internally-threaded nut 440 may include a lip 442 that has an exterior surface that has a non-hexagonal transverse cross-section such as, for example, a circular transverse cross-section. At least part of the interior surface of the nut 440 includes a plurality of threads 444. An O-ring, gasket or other member (not visible in FIG. 8) may be positioned between the internally threaded nut 440 and the connector body 420 to reduce or prevent water or moisture ingress into the interior of the connector 400. As shown in FIG. 8, the coaxial connector 400 may be mounted on the end of a coaxial cable 10 such that the center conductor 12 of the coaxial cable 10 extends into the interior of the internally-threaded nut 440.

The front end of the lip 442 is not threaded. Moreover, as shown in FIG. 8, the internally-threaded nut 440 further includes a pair of arcuate grooves 499 (only one of which is shown in the partial-cut-away view of FIG. 8) that are formed in the unthreaded portion of the interior surface of the lip 442 of internally-threaded nut 440. These arcuate grooves 499 act as a switch activator that activate a switch in a mating female connector port, as will be described in more detail below. In the embodiment of FIG. 8, the depth of each of the arcuate grooves 499 decreases with decreasing distance from the connector body 420.

As should be clear from the above description, the coaxial connector 400 of FIG. 8 is similar to the coaxial connector 100 of FIGS. 2 and 3, except that the coaxial connector 400 does not include a separate adapter 160. Thus, the male coaxial connector 400 does not include the body portion 170 of connector 100 that facilitates mounting the hollow conductive pin 184 onto the center conductor 12 of the coaxial cable 10. The connector 400 likewise does not include the locking member 190 of connector 100, and hence does not have a separate mechanism for locking the male coaxial connector 400 to a mating female connector port (although the threaded connection between the internally-threaded nut 440 and the threads on a mating female connector post provides a mechanism for attaching the connector 400 to a female connector port).

FIG. 9 is a perspective view of a female coaxial connector port 500 according to certain embodiments of the present invention that may be used with the male coaxial connector 400 of FIG. 8. As shown in FIG. 9, the female connector port 500 may be identical to the female connector port 200 that is described above with respect to FIGS. 4 and 5, and hence like elements of female connector port 500 are given the same reference numerals as the corresponding elements of the connector port 200, and will not be discussed further herein. However, as can be seen from FIG. 9, the female connector port 500 differs from female connector port 200 in that it does not include the bayonet connector pins 220. Otherwise, the female connector port 500 may be identical to the female connector port 200 of FIGS. 2 and 3.

Operation of the coaxial connector 400 and the female coaxial connector port 500 will now be described with reference to FIGS. 8-9. An installer places the internally-threaded nut 440 of connector 400 onto the distal end 214 of the cylindrical body 210 of the female connector port 500 so that the center conductor 12 of male coaxial connector 400 is aligned with the aperture 218 of the female connector port 500. The installer then pushes the connector 400 onto the female connector port 500 (and hence the center conductor 12 is inserted into the aperture 218) until the threads 444 of nut 440 engage the external threads 216 on the female connector port 500. The installer then rotates the internally-threaded nut 440 of the connector 400 in order to thread the nut 440 onto the female connector port 500.

As discussed above, the interior surface of the lip 442 of internally-threaded nut 440 includes first and second arcuate grooves 499. As the internally-threaded nut 440 is rotated through its final rotation(s), each of the activation pins 230 on the female connector port 500 is received within and travels through a respective one of the arcuate grooves 499. As noted above, the depth of each of the arcuate grooves 499 decreases with decreasing distance from the connector body 420. Consequently, the portion of the nut 440 that forms the bottom of each of the arcuate grooves 499 gradually forces the activation pins 230 inwardly into the interior of the female connector port 500 as the internally-threaded nut 440 is rotated through its final rotation(s). As discussed above with respect to the male connector 100 and the female connector port 200 of FIGS. 2-5, as the activation pins 230 move inwardly, they engage the prongs 246, 248 of the center conductor 240, and thereby force the prongs 246, 248 together so that an electrical connection is established between the prongs 246, 248 of the center conductor 240 of female connector port 500 and the center conductor 12 of male connector 400. Thus, the combination of male coaxial connector 400 and female connector port 500 may include the exact same type of switch and switch activator that are described above with respect to the combination of male coaxial connector 100 and female connector port 200. The switch may be configured to only establish an electrical connection through the mated male coaxial connector 400 and female connector port 500 when the male coaxial connector 400 is properly seated and fully tightened onto the female connector port 500.

Figure 10:
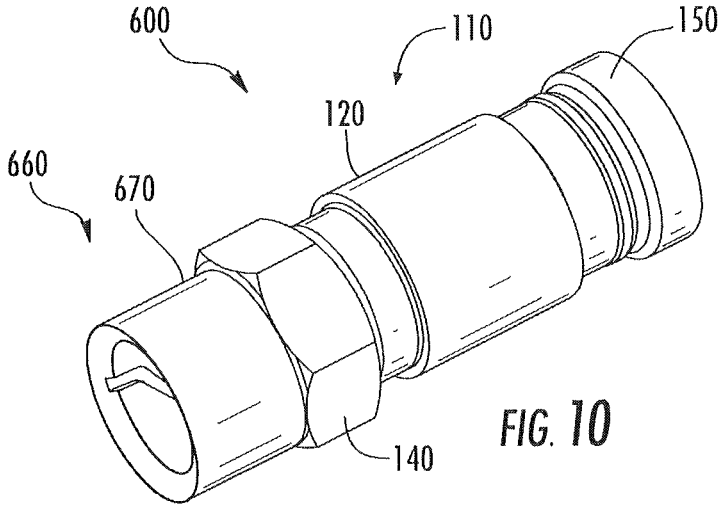
FIG. 10 is a perspective view of a male coaxial connector according to further embodiments of the present invention.
Figure 11:
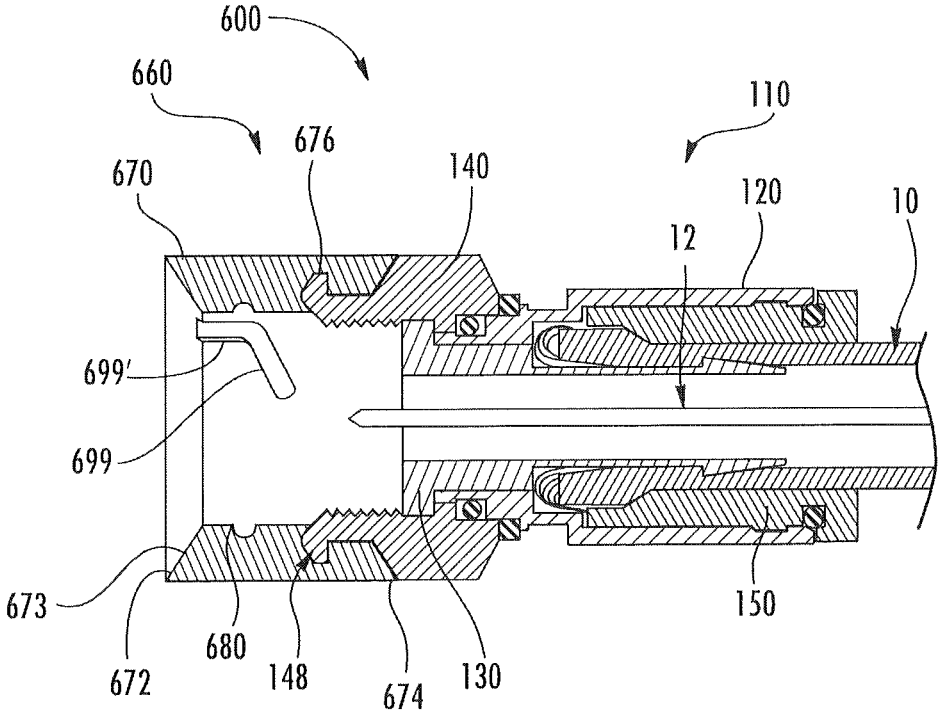
FIG. 11 is a longitudinal section view of the coaxial connector of FIG. 10.

FIG. 10 is a perspective view of a male coaxial connector 600 according to further embodiments of the present invention. FIG. 11 is a longitudinal section view of the coaxial connector 600 of FIG. 10. The male coaxial connector 600 provides both a locking feature and a switch activator in a simplified structure. The connector 600 may be used, for example, with the connector port 250 of FIG. 6.

As shown in FIGS. 10-11, the connector 600 comprises an F-style coaxial connector 110 and an adapter 660. The F-style coaxial connector 110 may be identical to the F-style coaxial connector 110 discussed above with respect to FIGS. 2-3, and hence will not be described further herein.

The adapter 660 may be mounted, for example, on the internally-threaded nut 140 of the F-style coaxial connector 110. The adapter 660 may comprise a single piece adapter that has a body portion 670. The body portion 670 has a front end 672 and a rear end 674. An annular groove 676 is provided proximate the rear end 674. The adapter 660 may be mounted on the F-style coaxial connector 110 by mounting the rear end 674 of the body 670 of the adapter 660 onto the lip 142 of the internally-threaded nut 140 such that the annular ridge 148 on the internally-threaded nut 140 is received within the annular groove 676 of the body portion 670. It will be appreciated that numerous other attachment mechanisms may be used such as, for example, the alternative attachment mechanisms discussed above with respect to the connector 100 of FIGS. 2 and 3.

As is further shown in FIG. 11, connector 600 differs from the connector 100 in that it does not include the internal threads 178, the conductive pin 184, the compression wedge 180 or the swaging block 182 that are part of the body portion 170 of connector 100. Instead, the threads 144 of the internally-threaded nut 140 are used to thread the connector 600 onto a mating female coaxial connector port, and the center conductor 12 of the coaxial cable 10 to which connector 600 is attached serves as the male protrusion and center conductor of the connector 600. Additionally, an interior surface of the body portion 670 includes an internal annular groove 680. As will be discussed below, this groove 680 may receive spring-loaded ball bearings that are mounted on a mating female connector port to lock the connector 600 onto the female connector port.

The connector 600 may be mounted onto the female connector port 250 of FIG. 6 as follows. The front end of the connector 600 is placed onto the female connector port 250 so that the center conductor 12 of connector 600 is received within the aperture 218 of the connector port 250. As the body portion 670 is moved onto the female connector port, the front end 672 comes into contact with the ball bearings 260 on the female connector port 250. As shown in FIGS. 10-11, the front end 672 has a radial flange 673 at the front end thereof. The radial flange 673 has a larger diameter on its front end than on its back end. As the ball bearings 260 contact the radial flange 673, the slanted surface on the flange 673 forces the ball bearings 260 into their respective cavities 264 as the connector 600 is pushed farther onto the connector port 250. Thus, the radial flange 673 acts to depress the ball bearings 260 into their respective cavities 264 so that the male connector 600 may be fully inserted onto the female connector port 250.

As the connector 600 is moved onto the female connector port 250, eventually the internal threads 144 of nut 140 come into contact with the external threads 216 of connector port 250, at which point the installer rotates the nut 140 to thread the nut 140 onto the female connector port 250. Once the connector 600 has been fully threaded onto the female connector port 250, it will travel a sufficient distance onto the body 210 of female connector port 250 such that the ball bearings 260 are transversely aligned with the annular groove 680. When this occurs, the internal surface of the body portion 670 no longer acts to force the ball bearings 260 into their respective cavities 264, and hence the spring that is included in each cavity 264 forces the respective ball bearings 260 outward so that an outer surface of each ball bearing 260 resides in the annular groove 680. While the connector 600 may be removed from the female connector port 250 by exerting a sufficient force in the longitudinal direction that the ball bearings 260 are forced out of the annular groove 680 and back into their respective cavities 264, the locking of the ball bearings 260 within the groove 680 provides a robust connection and hence acts to resist loosening of the threaded connection between the nut 140 and the female connector port 250.

As is further shown in FIGS. 10-11, the body portion 670 may further include a pair of arcuate grooves 699 and a pair of longitudinal grooves 699' that provide access to the respective arcuate grooves 699 (only one arcuate groove 699 and one longitudinal groove 699' are visible in FIGS. 10-11) Each arcuate groove 699 and its corresponding longitudinal groove 699' may act as a switch activator. The arcuate grooves 699 and the longitudinal grooves 699' may be identical to the arcuate grooves 199 and the longitudinal grooves 199' discussed above with respect to connector 100 of FIGS. 2-3, except that arcuate grooves 699 and the longitudinal grooves 699' are included in the internal surface of the body portion 670 of the connector as opposed to being provided in a separate locking mechanism as is the case with respect to the arcuate grooves 199 and the longitudinal grooves 199' discussed above with respect to connector 100 of FIGS. 2-3. Similar to the discussion above, as the connector 600 is mounted onto the female connector port 250, each activation pin 230 on the connector port 250 travels through its respective longitudinal groove 699' into its respective arcuate groove 699. The decreasing depth of these arcuate grooves 699 act to gradually force the activation pins 230 inwardly into the interior of the female connector port 250 as the installer rotates the connector 600 onto the female connector port 250. As the activation pins 230 move inwardly, they engage respective ones of the prongs 246, 248 of the center conductor 240, and thereby force the prongs 246, 248 together so that the prongs 246, 248 come into mechanical and electrical contact with the center conductor 12 of the coaxial connector 600.

Figure 12:
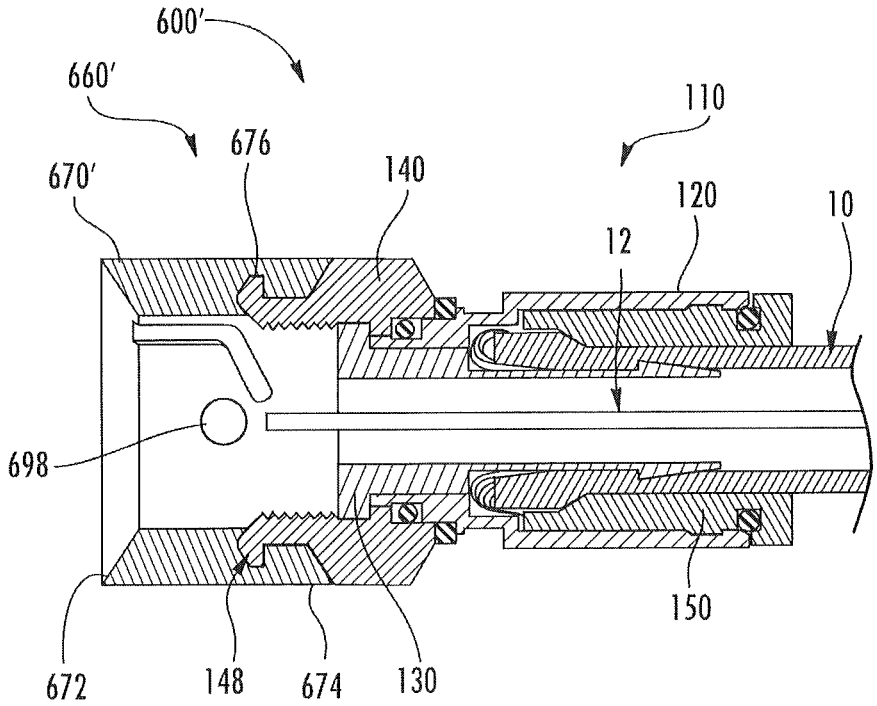
FIG. 12 is a longitudinal section view of a modified version of the male coaxial connector of FIGS. 10-11.

FIG. 12 is a longitudinal section view of a connector 600' according to still further embodiments of the present invention. The connector 600' may be almost identical to the connector 600 described above with respect to FIGS. 10-11, except that the connection between the internally-threaded nut 140 and the body portion 670 is modified so that the adapter 660' rotates freely with respect to the internally-threaded nut 140 (in the embodiment of FIGS. 10-11, the connection between the internally-threaded nut 140 and the body portion 670 is modified may or may not be designed so that the adapter 660 rotates freely with respect to the internally-threaded nut 140). Additionally, in the connector 600', the annular groove 680 of connector 600 is replaced with a pair of apertures 698 that may be identical to the apertures 398 of the connector 300, except that the apertures 698 are in the body portion 670' of the adapter 660'. The connector 600' may work in the same manner as connector 600, except that the ball bearings 260 on the female connector port 250 are received within the apertures 698 as opposed to the groove 680 of connector 600. The ability to rotate the body portion 670' independent of the nut 140 allows the installer to rotate the body portion 670' as necessary to align the ball bearings 260 with the apertures 698 so that the ball bearings 260 may pop through the apertures 698 to lock the connector 600' onto the female connector port 250.

Figure 13:
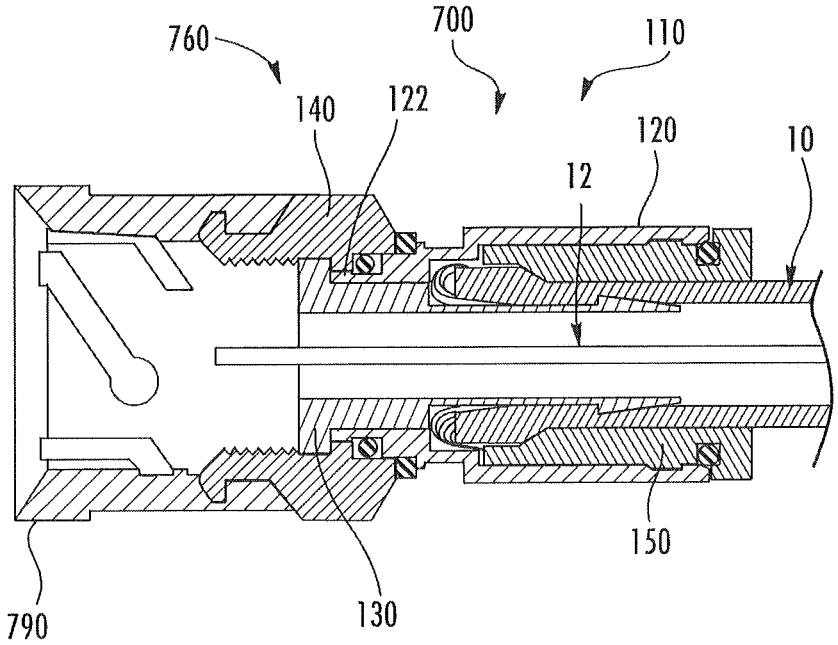
FIG. 13 is a longitudinal section view of a coaxial connector according to still further embodiments of the present invention.

FIG. 13 is a longitudinal section view of a coaxial connector 700 according to still further embodiments of the present invention. The connector 700 comprises an F-style coaxial connector 110 and an adapter 760. The F-style coaxial connector 110 may be identical to the F-style coaxial connector 110 discussed above with respect to FIGS. 2-3, and hence will not be described further herein. As is apparent from FIG. 13, the coaxial connector 700 is similar to the coaxial connector 100 of FIGS. 2-3, except that the adapter 760 thereof does not include a body portion such as the body portion 170 of the connector 100. As a result, the adapter 760 of connector 700 only comprises a locking member 790. The locking member 790 is attached directly to the internally-threaded nut 140 of the F-style coaxial connector 110, and is attached so that the locking member 790 may rotate independently of the nut 140.

The connector 700 may operate similar to the connectors described above. In particular, the locking member 790 may be used to lock the connector 700 onto a female connector port such as the female connector port 200 described above in the same manner that the locking member 190 of connector 100 is used for the identical purpose. Likewise, the internally-threaded nut 140 of connector 700 may be directly threaded onto the female connector port 200 in the same manner that the nut 140 of connector 600 may be threaded onto a female connector port.

Figure 14:
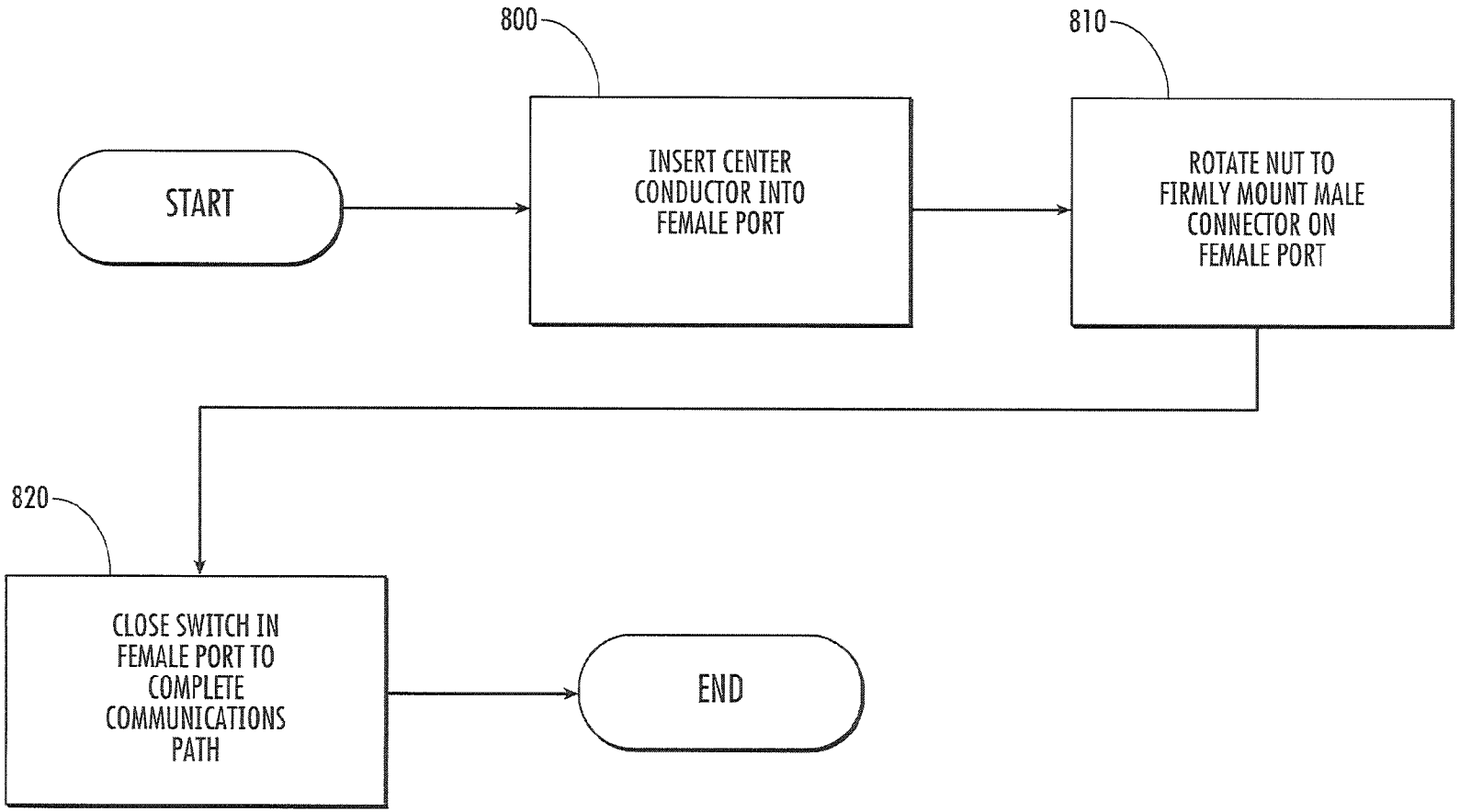
FIG. 14 is a flowchart of a method of establishing a radio frequency communications path between a male coaxial connector and a female coaxial connector port according to certain embodiments of the present invention.

FIG. 14 is a flowchart of a method of establishing a radio frequency communications path between a male coaxial connector and a female coaxial connector port according to certain embodiments of the present invention. As shown in FIG. 14, operations may begin with an installer inserting a center conductor of the male coaxial connector into a center conductor receiving aperture of the female coaxial connector port to make electrical contact with a center conductor of the female connector port (block 810). The installer may then rotate a nut on the male coaxial connector to firmly mount the male coaxial connector onto the female coaxial connector port (block 820). An activation circuit within the female connector port may be closed in order to complete a communications path through the female connector port (block 830). In some embodiments, the rotation of the nut may close the activation circuit within the female connector port in order to complete the communications path through the female connector port.

It will be appreciated that many modifications may be made to the various embodiments of the present invention described above without departing from the scope of the present invention. By way of example, other switches and switch activators may be used in place of the spring-loaded pins and arcuate grooves discussed above with respect to various embodiments of the present invention. Likewise, in some embodiments, the switch may be provided on the male coaxial connector and the switch activator may be provided on the female connector port. It will also be appreciated that in some embodiments, a single arcuate groove and spring loaded pin may be used as the switch and switch activator as opposed to the pair of such components depicted in the pictured embodiments above. It will further be appreciated that the features and components of the various embodiments described above may be further mixed and matched to provide yet additional embodiments of the present invention. It will likewise be appreciated that multiple components of the male coaxial connectors and/or female coaxial connector ports described above may be combined into a single piece and/or that some of the components may be implemented as multi-part components.

The coaxial connectors according to certain embodiments of the present invention may provide a replacement for conventional F-style coaxial connectors that have backwards compatibility in that they may be used on conventional female connector ports. According to some embodiments, the male coaxial connector includes an adapter that may be mounted on a conventional F-style male coaxial connector. These adapters may be installed in the factory or in the field.

Thus, as described above, pursuant to embodiments of the present invention, hybrid male coaxial connectors and associated female connector ports are provided. These connectors may provide improved mechanical and/or electrical connections. Both the male connectors and the female connector ports according to some embodiments of the present invention may be capable of interfacing with existing F-style coaxial connectors/connector ports. The connectors/connector ports according to embodiments of the present invention may include a positive mechanical locking interface, an improved electrical contact, and/or an switch that only activates a communications path through the mated connection if the male connector is properly installed on the female connector port. In some embodiments, the connectors/connector ports may include components of both conventional F-style connectors and components of conventional BNC-style connectors.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A coaxial connector, comprising:

a connector body having a front end and a rear end;

a compression sleeve that is received within the rear end of the connector body;

an inner contact post that is at least partly within the connector body;

a first internally-threaded nut that is positioned at the front end of the connector body and that is connected to at least one of the connector body and the inner contact post; and a second internally-threaded nut that extends forwardly from a front end of the first internally-threaded nut, the second internally-threaded nut including a body and a plurality of threads on an inner surface of the body.

2. The coaxial connector of claim 1, further comprising a locking mechanism that is attached to or part of the second internally-threaded nut, wherein the locking mechanism is configured to engage a mating locking mechanism of a female connector port.

3. The coaxial connector of claim 2, wherein the locking mechanism is part of a separate locking member that is rotatably attached to the second internally-threaded nut, and wherein the locking mechanism comprises at least one cam-lock mechanism.

4. The coaxial connector of claim 1, further comprising a moveable compression wedge that is mounted within the second internally-threaded nut.

5. The coaxial connector of claim 4, further comprising a stop that is mounted within the second internally-threaded nut adjacent a first end of the compression wedge, the stop having a surface that is configured to compress an exterior surface of the first end of the compression wedge inwardly when the compression wedge is forced against the surface.

6. The coaxial connector of claim 5, wherein the stop comprises a swaging block.

7. The coaxial connector of claim 6, further comprising a conductive pin that is positioned to run through a first aperture in the compression wedge and a second aperture in the stop.

8. The coaxial connector of claim 2, wherein the locking mechanism is part of a separate locking member, and wherein the locking member further includes a switch activator.

9. The coaxial connector of claim 8, wherein the switch activator comprises a groove that has a variable depth on an interior surface of the locking member.

10. The coaxial connector of claim 9, wherein the groove in the interior surface of the locking member is configured to engage and push in a pin on a female connector port when the locking member is mounted on the female connector port and rotated to lock the coaxial connector in place on the female connector port.

* * * * *